US008159141B2

(12) United States Patent
Kuang et al.

(10) Patent No.: US 8,159,141 B2
(45) Date of Patent: Apr. 17, 2012

(54) METHODS AND APPARATUS FOR DRIVING DISCHARGE LAMPS

(75) Inventors: Naixing Kuang, Hangzhou (CN); Lei Du, Hangzhou (CN); Junming Zhang, Hangzhou (CN); Yuancheng Ren, Hangzhou (CN)

(73) Assignee: Monolithic Power Systems, Inc., San Jose, CA (US)

( * ) Notice: Subject to any disclaimer, the term of this patent is extended or adjusted under 35 U.S.C. 154(b) by 417 days.

(21) Appl. No.: 12/510,089

(22) Filed: Jul. 27, 2009

(65) Prior Publication Data

US 2010/0072906 A1 Mar. 25, 2010

(30) Foreign Application Priority Data

Sep. 19, 2008 (CN) ..... 2008 1 0046109

(51) Int. Cl.
*H05B 37/02* (2006.01)
*H05B 39/04* (2006.01)
*H05B 41/36* (2006.01)

(52) U.S. Cl. ..... 315/209 R; 315/291; 315/297; 315/307

(58) Field of Classification Search ..... None
See application file for complete search history.

(56) References Cited

U.S. PATENT DOCUMENTS

| | | | | |
|---|---|---|---|---|
| 6,051,940 | A * | 4/2000 | Arun | 315/307 |
| 2007/0029945 | A1 * | 2/2007 | Yu et al. | 315/224 |
| 2007/0267984 | A1 * | 11/2007 | Peng | 315/312 |
| 2008/0012510 | A1 * | 1/2008 | Po | 315/308 |

* cited by examiner

*Primary Examiner* — Anh Tran
(74) *Attorney, Agent, or Firm* — Perkins Coie LLP

(57) ABSTRACT

Methods and apparatus for driving discharge lamps are disclosed herein. In one embodiment, a method for driving a discharge lamp includes generating a switching signal to drive a discharge lamp, monitoring a working status of the discharge lamp, and determining whether the discharge lamp is operating abnormally based at least in part on the monitored working status. The method also includes decreasing a duty cycle of the switching signal when the discharge lamp is determined to operate abnormally.

5 Claims, 12 Drawing Sheets

METHODS AND APPARATUS FOR DRIVING DISCHARGE LAMPS

CROSS-REFERENCE TO RELATED APPLICATION(S)

This application claims priority to Chinese patent application No. 200810046109.3, filed Sep. 19, 2008, which is hereby incorporated by reference in its entirety.

TECHNICAL FIELD

The present disclosure generally relates to switching circuits for driving discharge lamps and associated methods of operation.

BACKGROUND

Cold cathode fluorescent lamp (CCFL), external electrode fluorescent lamp (EEFL), and other types of discharge lamps are widely used to backlight liquid crystal displays (LCD). Such discharge lamps all require a driving mechanism for supplying an alternating current (AC) driving voltage and a stable high-frequency lamp current.

Typically, discharge lamps require a striking voltage (e.g., a few hundred volts) to initiate or strike an electrical arc in the discharge lamps. The striking voltage can be even higher (e.g., 1000-2000 volts) under low temperature and/or aging conditions. Once an electrical arc is struck inside the discharge lamps, the terminal voltage may fall to an operation voltage (e.g., a few hundred volts), and the brightness produced depends on the current flowing through the discharge lamps. When a driving circuit detects that a discharge lamp is in an open circuit (e.g., the electric arc has not been struck yet; the lamp is not properly coupled to the terminals; or the lamp malfunctions), the driving circuit would provide the striking voltage to the terminals and attempts to re-strike the electric arc in the discharge lamp. If the driving circuit still detects an open circuit after a preset amount of time, the driving circuit would determine that the lamp is not properly coupled to the terminal or the lamp has malfunctioned, and cease attempting to re-strike the electric arc in the discharge lamp for self-protection.

Typically, conventional driving circuits adjust the brightness of discharge lamps based on a lamp current feedback signal in normal operation, and adjust the terminal voltage based on a lamp voltage feedback signal in open circuit conditions. The driving circuits can also include protection circuitry that monitors the terminal voltage and terminates the driving circuits when the terminal voltage exceeds a threshold for longer than a preset amount of time (e.g., 1 second). To provide a sufficient striking voltage, the driving circuits often utilize frequency hopping techniques in which the working frequency is increased to a preset value after an open circuit is detected.

FIG. 1 is a block diagram of a driving circuit for driving a single discharge lamp in accordance with the prior art. As shown in FIG. 1, the driving circuit includes a switching circuit 101, a control circuit 102, a transformer 103, a resonant circuit 104, and a load 105 that includes a single discharge lamp L. The switching circuit 101 comprises at least one switch that receives a direct current (DC) input voltage $V_{in}$ and generates a switching signal SW. The control circuit 102 is electrically coupled to the switching circuit 101 and controls the on/off of the at least one switch. The transformer 103 is electrically coupled between the switching circuit 101 and the resonant circuit 104. The primary winding of the transformer 103 receives the switching signal SW, and the secondary winding of the transformer 103 accordingly generates an AC signal. The resonant circuit 104 is electrically coupled between the transformer 103 and the load 105. The resonant circuit 104 receives the AC signal and generates an output voltage $V_{out}$ to drive the load 105.

When the input voltage $V_{in}$ and circuit parameters are constant, the output voltage $V_{out}$ of the driving circuit is determined by the duty cycle of the switching signal SW and the voltage gain of the resonant circuit 104 and the load 105. The voltage gain is related to the operating conditions of the load 105 (whether the lamp L is open) and the switching frequency of the switching signal SW. Typically, the lamp current or the lamp voltage is monitored and compared with a threshold to detect whether the lamp is under open circuit condition. However, in a transient open circuit state, the duty cycle of the switching signal does not have time to adjust, and there is a delay between the lamp reaching open circuit and the driving circuit detecting the open circuit condition.

FIG. 2 is a curve showing a relationship between the switching frequency and the voltage gain of the resonant circuit 104 and the load 105 as a function of the switching frequency. In normal operation, the gain curve is curve a, the switching frequency is the operation frequency $f_s$, and the voltage gain is G1. The corresponding output voltage $V_{out}$ is the normal working voltage $V_{o,normal}$. The operation frequency $f_s$ is generally set to be slightly higher than the resonant frequency of the resonant circuit 104 and the load 105. Under open circuit conditions, the gain curve is the curve b. If the switching frequency is maintained at the operation frequency $f_s$, the voltage gain will be G2>G1. The difference between G2 and G1 is determined by the resonant parameters of the resonant circuit 104 and also the characteristic of the lamp L.

Generally, G2 is not large enough to allow the output voltage $V_{out}$ to reach the striking voltage, so a frequency hopping technique is usually used. Once the open circuit condition is detected, the switching frequency is set to a higher frequency $f_{s,open}$ to obtain a voltage gain G3, and G3>G1,G2. The frequency $f_{s,open}$ may be set by external resistors or voltages, or it may be set internally. If the frequency $f_{s.open}$ is set internally, under some conditions (related to the resonant parameters of the resonant circuit 104), the instant output voltage $V_{out}$ during frequency hopping may be too high to cause the failure of the lamp L and/or the other electrical elements.

FIG. 3 is a diagram illustrating a waveform of the peak output voltage $V_{out}$ with respect to time during lamp initiation. At t=0, the driving circuit is powered on, the lamp L is not ignited, and the open circuit condition is not detected. The switching frequency is the operation frequency $f_s$ and the voltage gain is G2. During 0<t<t1, the duty cycle of the switching signal SW is increased by the control circuit 102, and the output voltage $V_{out}$ is increased accordingly. At t=t1, the open circuit condition is detected, the frequency is set to the frequency $f_{s,open}$, and the voltage gain is G3. If G3 is large enough, there will be an overshoot $V_{os1}$ across the lamp L. Then, the duty cycle of the switching signal SW is decreased by the control circuit 102 until the output voltage $V_{out}$ is regulated to the striking voltage $V_{o,strike}$. At t=t2, the lamp L is ignited, the switching frequency is set to be the operation frequency $f_s$ again, the voltage gain is G1 and the output voltage $V_{out}$ is the operation voltage $V_{o,normal}$.

FIG. 4 is a diagram illustrating a waveform of the peak output voltage $V_{out}$ with respect to time before and after a lamp opening. Before t=t3, the driving circuit is in normal operation, the switching frequency is the operation frequency $f_s$, the voltage gain is G1 and the output voltage is the operation voltage $V_{o,normal}$. At t=t3, the lamp L is open, but the open circuit condition is not detected, the switching frequency is maintained at the operation frequency $f_s$, the voltage gain is G2 and the output voltage is $V_{os2}$. During t3<t<t4, the duty cycle of the switching signal SW is increased by the control circuit 102, and the output voltage $V_{out}$ is increased accordingly. At t=t4, the open circuit condition is detected, the frequency is set to the frequency $f_{s,open}$, and the voltage gain is G3. If the difference between G3 and G2 is large enough, there will be an overshoot $V_{os3}$ across the lamp L. Then, the duty cycle of the switching signal SW is decreased by the control circuit 102, until the output voltage $V_{out}$ is regulated to the striking voltage $V_{o,strike}$. At t=t5, the lamp L is ignited again, the switching frequency is set to be the operation frequency $f_s$, the voltage gain is G1 and the output voltage $V_{out}$ is the operation voltage $V_{o,normal}$.

FIG. 5 is a block diagram of a driving circuit for driving two serially connected discharge lamps. The driving circuit is similar to the one shown in FIG. 1, except that the load 105 comprises two serially connected discharge lamps L1 and L2. The lamps L1 and L2 may not be ignited at the same time because of their characteristic differences. If L1 is ignited first, its instant impedance will be decreased during ignition, which will cause an overshoot across L2. L1 may be ignited before or after the open circuit condition is detected. If the frequency hopping technique is used, there will be two overshoots across L2, one caused by the frequency hopping, and the other caused by the ignition of L1. If one of the two discharge lamps opens during normal operation (e.g., L2 is open), its instant impedance will increase during circuit opening to cause a voltage overshoot across L2. After a delay, if the driving circuit detects the opening circuit condition and uses the frequency hopping technique, it will cause another overshoot across L2.

DETAILED DESCRIPTION OF THE INVENTION

Specific details of several embodiments of the disclosure are described below with reference to driving circuits for driving discharge lamps and associated methods of operation. Moreover, several other embodiments of the converters may have different configurations, components, or procedures than those described in this section. A person of ordinary skill in the art, therefore, will accordingly understand that the converters and the associated methods of operation may have other embodiments with additional elements, or the invention may have other embodiments without several of the elements shown and described below with reference to FIGS. 6-12.

Figure 1:
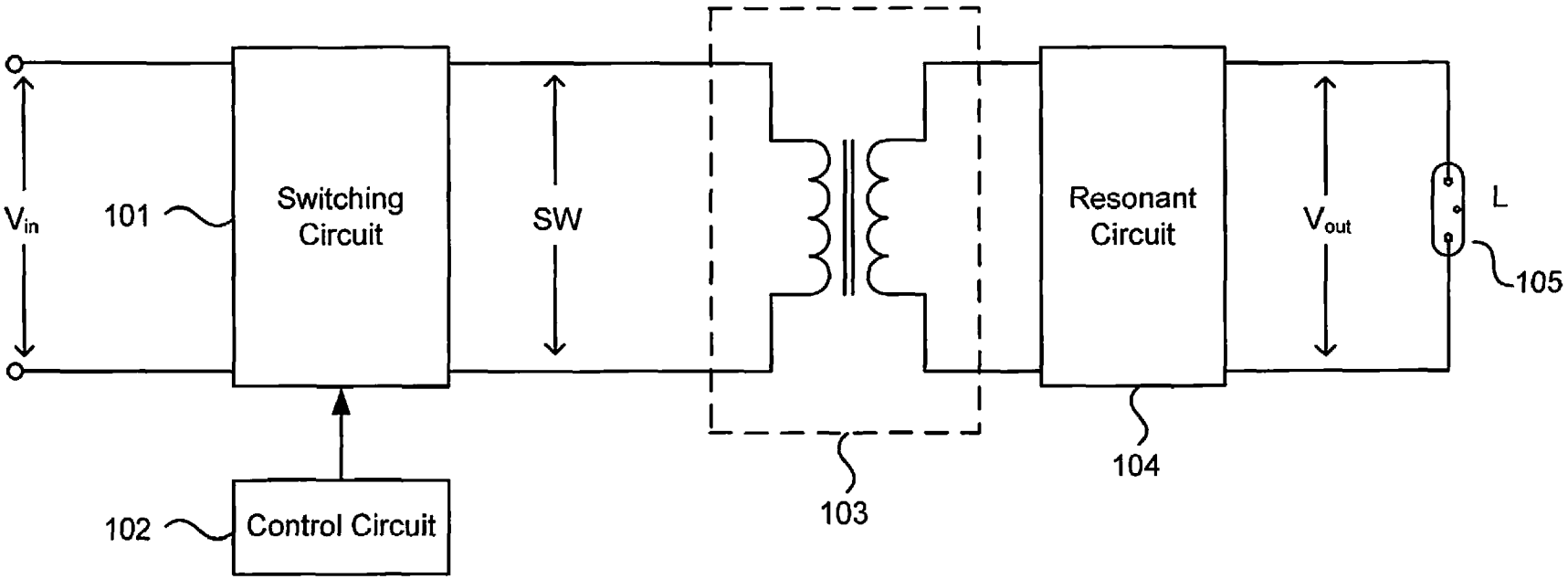
FIG. 1 is a block diagram of a driving circuit for driving a single discharge lamp in accordance with the prior art
Figure 2:
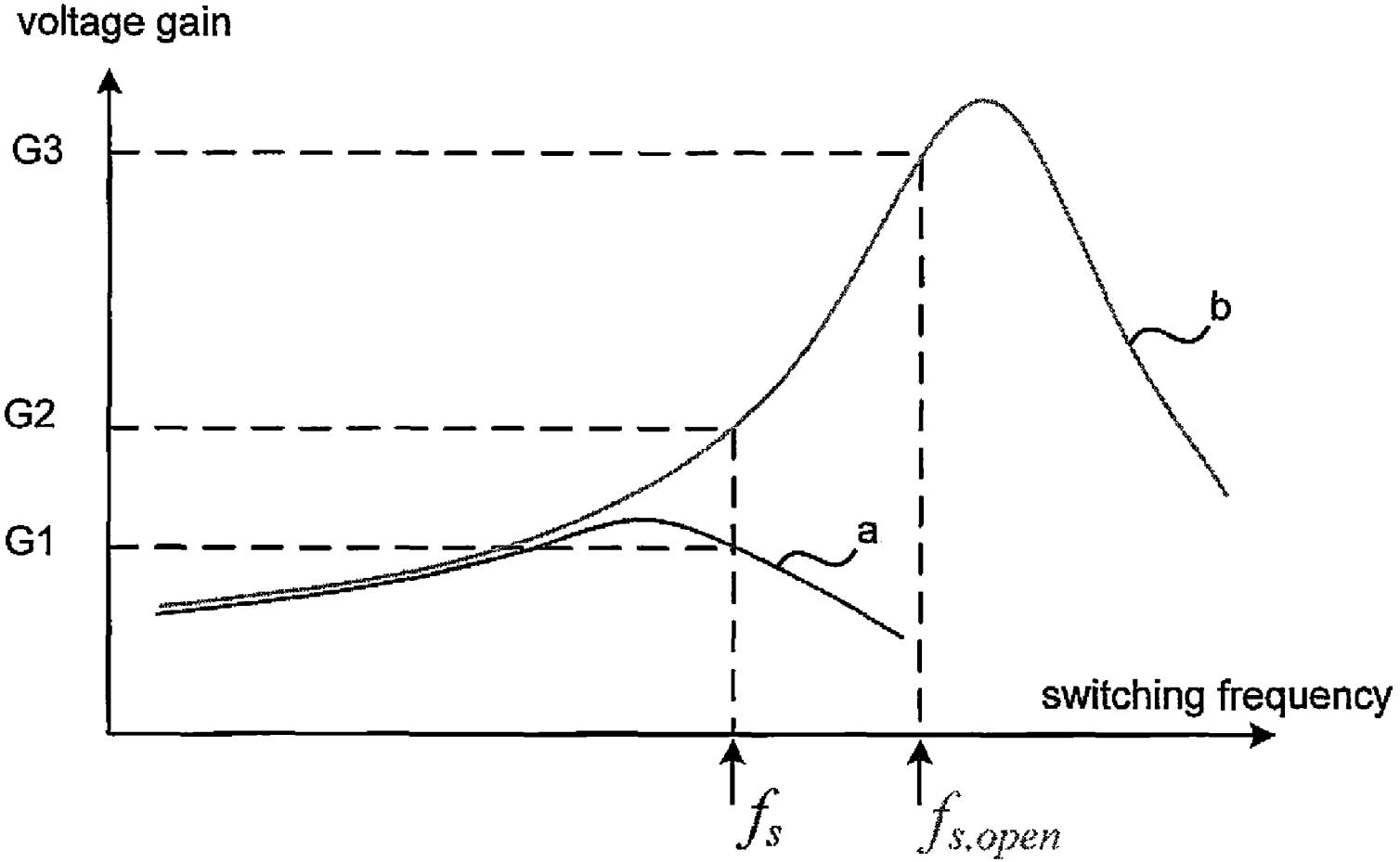
FIG. 2 is a curve showing a relationship between the switching frequency and the voltage gain of the driving circuit in FIG. 1.
Figure 3:
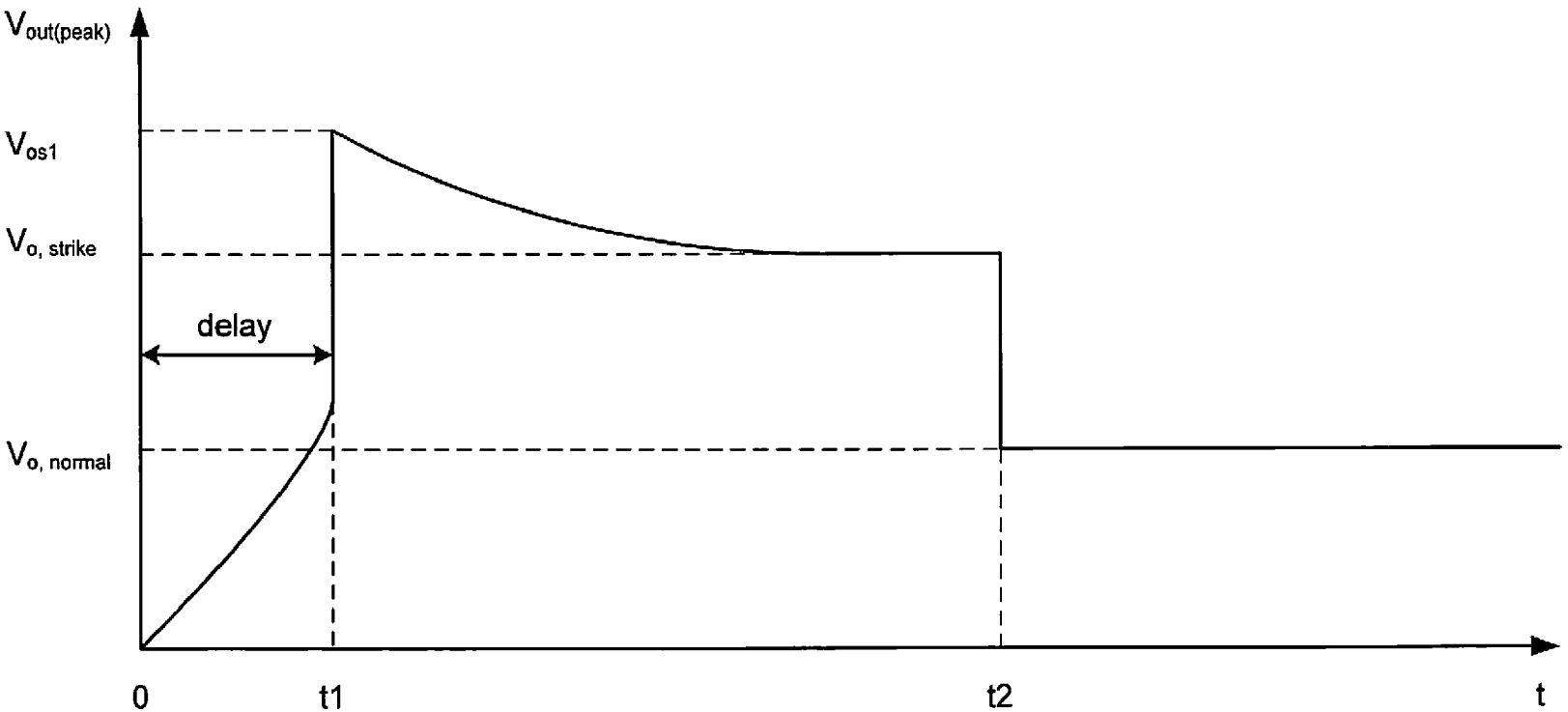
FIG. 3 is a diagram illustrating a waveform of the peak output voltage with respect to time during ignition in the driving circuit in FIG. 1.
Figure 4:
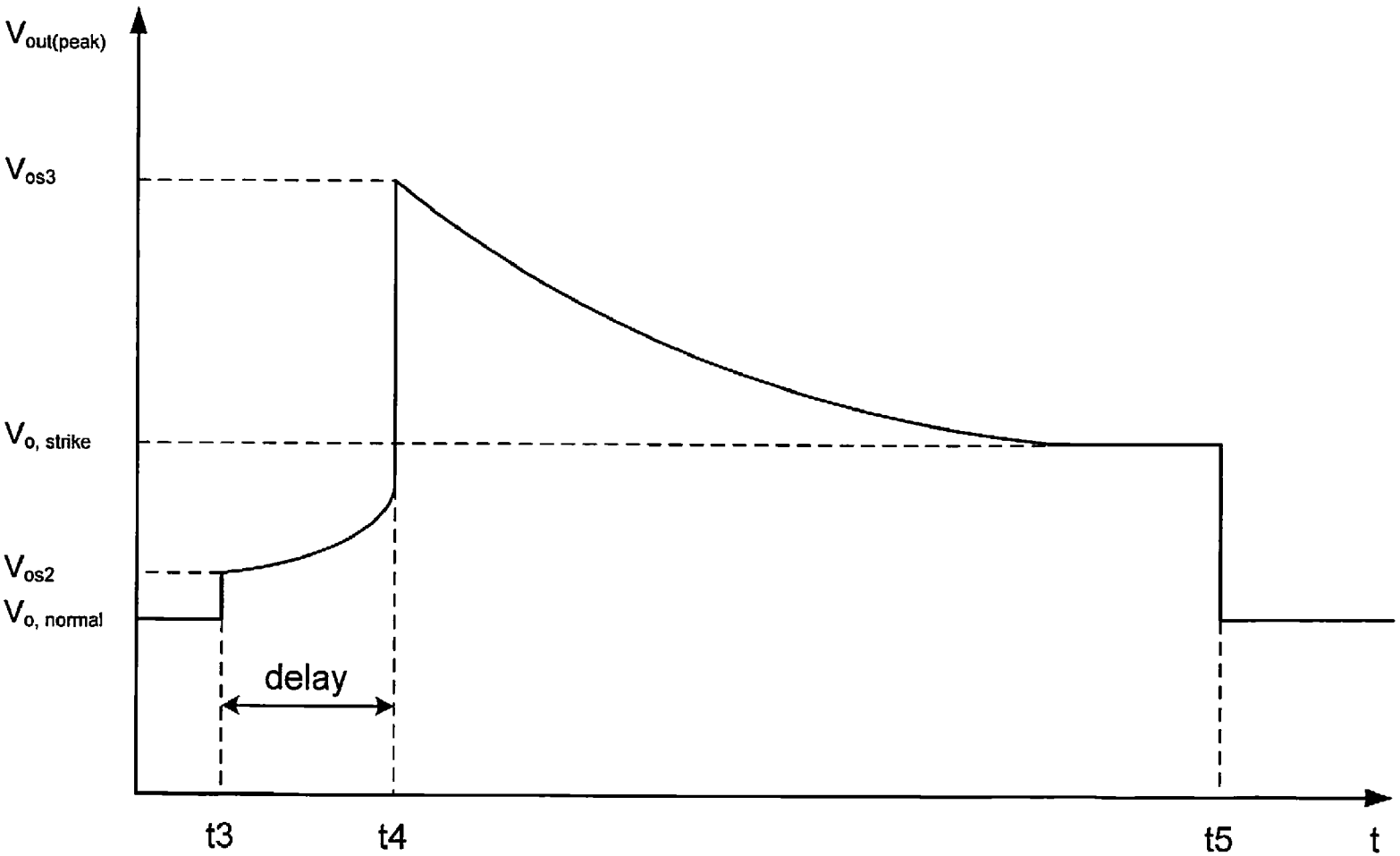
FIG. 4 is a diagram illustrating a waveform of the peak output voltage with respect to time before and after a lamp opening in the driving circuit in FIG. 1.
Figure 5:
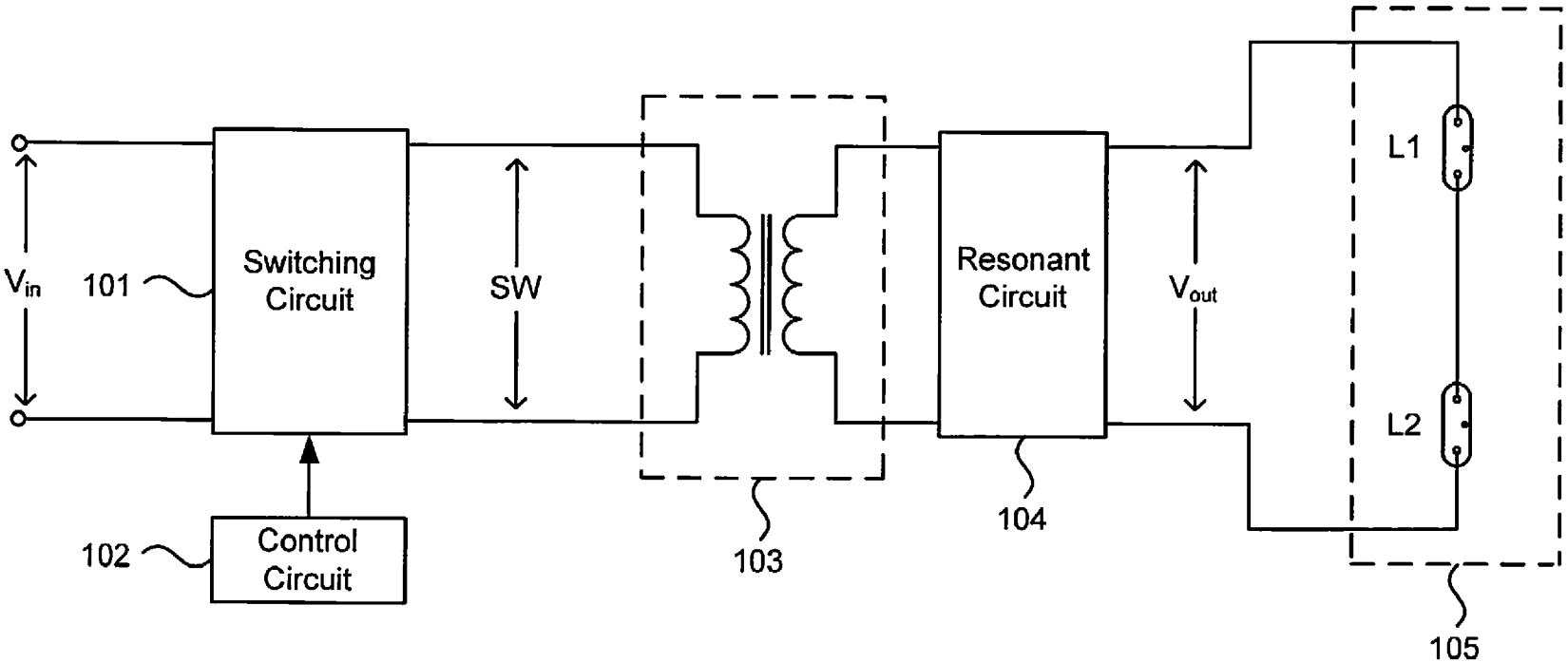
FIG. 5 is a block diagram of a driving circuit for driving two serially connected discharge lamps in accordance with the prior art.
Figure 6:
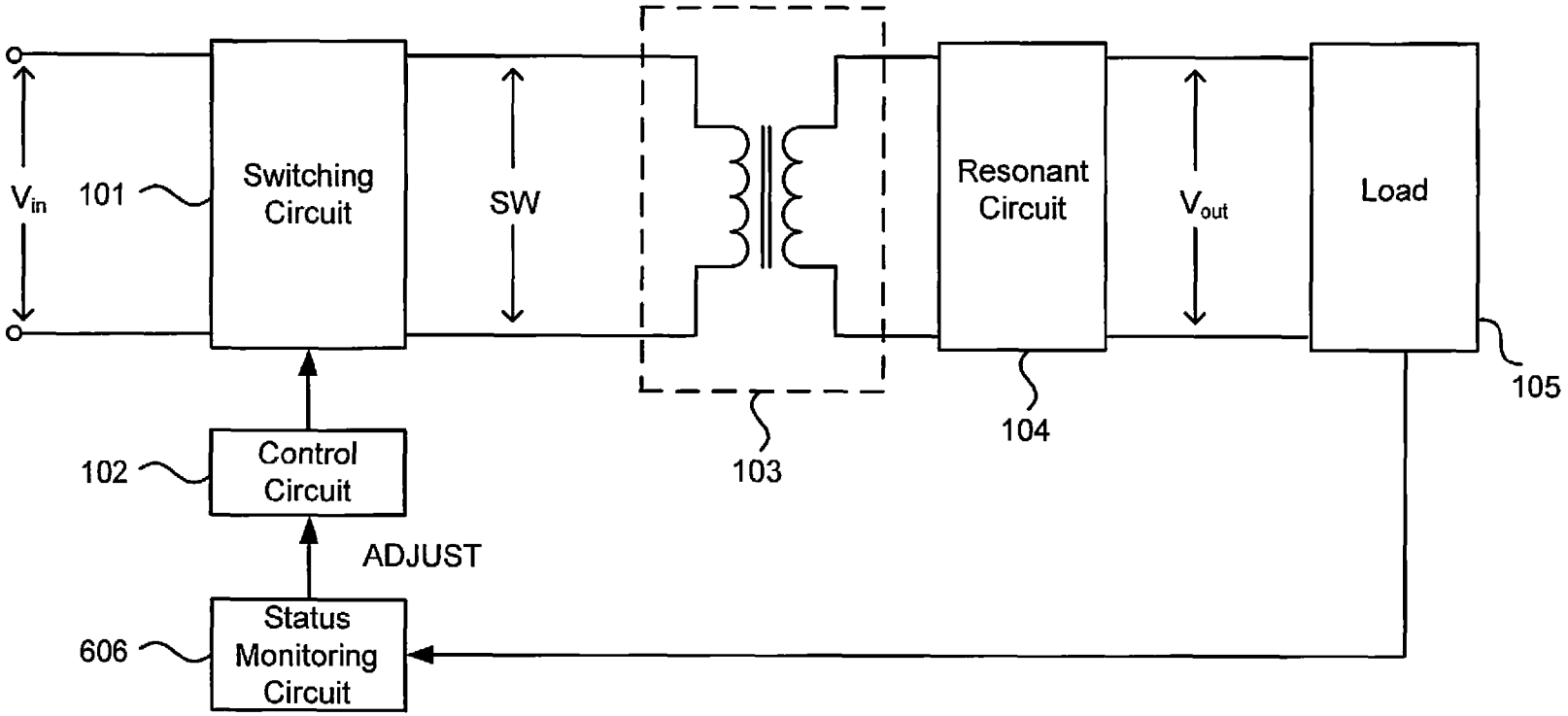
FIG. 6 is a block diagram of a driving circuit for driving discharge lamps in accordance with embodiments of the disclosure.

FIG. 6 is a block diagram of a driving circuit for driving discharge lamps in accordance with embodiments of the disclosure. As shown in FIG. 6, the driving circuit comprises a switching circuit 101, a control circuit 102, a transformer 103, a resonant circuit 104, a load 105, and a status monitoring circuit 606. The switching circuit 101 comprises at least one switch that receives a DC input voltage $V_{in}$ and generates a switching signal SW. The switching circuit 101 may be configured in half-bridge, full-bridge, push-pull, and/or other suitable DC/AC topology.

The control circuit 102 is electrically coupled to the switching circuit 101 and the status monitoring circuit 606. The control circuit 102 receives an adjustment signal ADJUST from the status monitoring circuit 606 and generates a control signal to control the switching circuit 101. The control signal can be adjusted to reduce the duty cycle of the switching signal SW when the adjustment signal ADJUST is valid, so as to reduce the output voltage $V_{out}$ and avoid overshoot. In one embodiment, the duty cycle of the switching signal SW is reduced to one half of its original value when the adjustment signal ADJUST is valid. In other embodiments, the duty cycle of the switching signal SW is reduced to other suitable values when the adjustment signal ADJUST is valid.

The control circuit 102 can be electrically coupled to the load 105 to sense the electrical parameters of the lamps (such as current, voltage, and/or power) and to generate the control signal accordingly. In one embodiment, the control circuit 102 regulates the lamp current to control the lamp brightness if no open circuit condition is detected, and regulates the lamp voltage to the striking voltage if the open circuit condition is detected.

The transformer 103 is electrically coupled between the switching circuit 101 and the resonant circuit 104. The primary winding of the transformer 103 receives the switching signal SW, and the secondary winding generates an AC signal accordingly. The transformer 103 may comprise multiple primary and secondary windings.

The resonant circuit 104 is electrically coupled between the transformer 103 and the load 105. The resonant circuit 104 receives the AC signal and generates an output voltage $V_{out}$ to drive the load 105. The resonant circuit 104 generally comprises a resonant inductance and a resonant capacitance. The resonant inductance may be a free inductance, or composed of the leakage inductance and/or the excitation inductance of the transformer. The resonant capacitance may be a free capacitance, or composed of the distributed and parasitic capacitance of the discharge lamp. The load 105 may comprise a single discharge lamp or multiple discharge lamps. In one embodiment, the resonant circuit 104 is electrically coupled between the switching circuit 101 and the transformer 103, while the load 105 is electrically coupled to the transformer 103. In other embodiments, the load 105 may be suitably connected to other components of the driving circuit.

The status monitoring circuit 606 is electrically coupled to the load 105 and the control circuit 102. The status monitoring circuit 606 monitors the working status of the load 105 and generates the adjustment signal ADJUST. The adjustment signal ADJUST is valid when the abnormal working status of the load 105 is detected. In one embodiment, the status monitoring circuit 606 detects whether the open circuit condition exists and validates the adjustment signal ADJUST when the open circuit condition is detected. In another embodiment, the status monitoring circuit 606 detects whether the voltage across the lamp is over-voltage and validates the adjustment signal when the over-voltage condition is detected. In still another embodiment, the status monitoring circuit 606 detects whether the open circuit condition exists and whether the voltage across the lamp is over-voltage. The adjustment signal ADJUST is validated when the open circuit condition or over-voltage condition is detected. In certain embodiments, the control circuit 102 may respond to a valid adjustment signal ADJUST only once, until the normal working status of the discharge lamps resumes.

Figure 7:
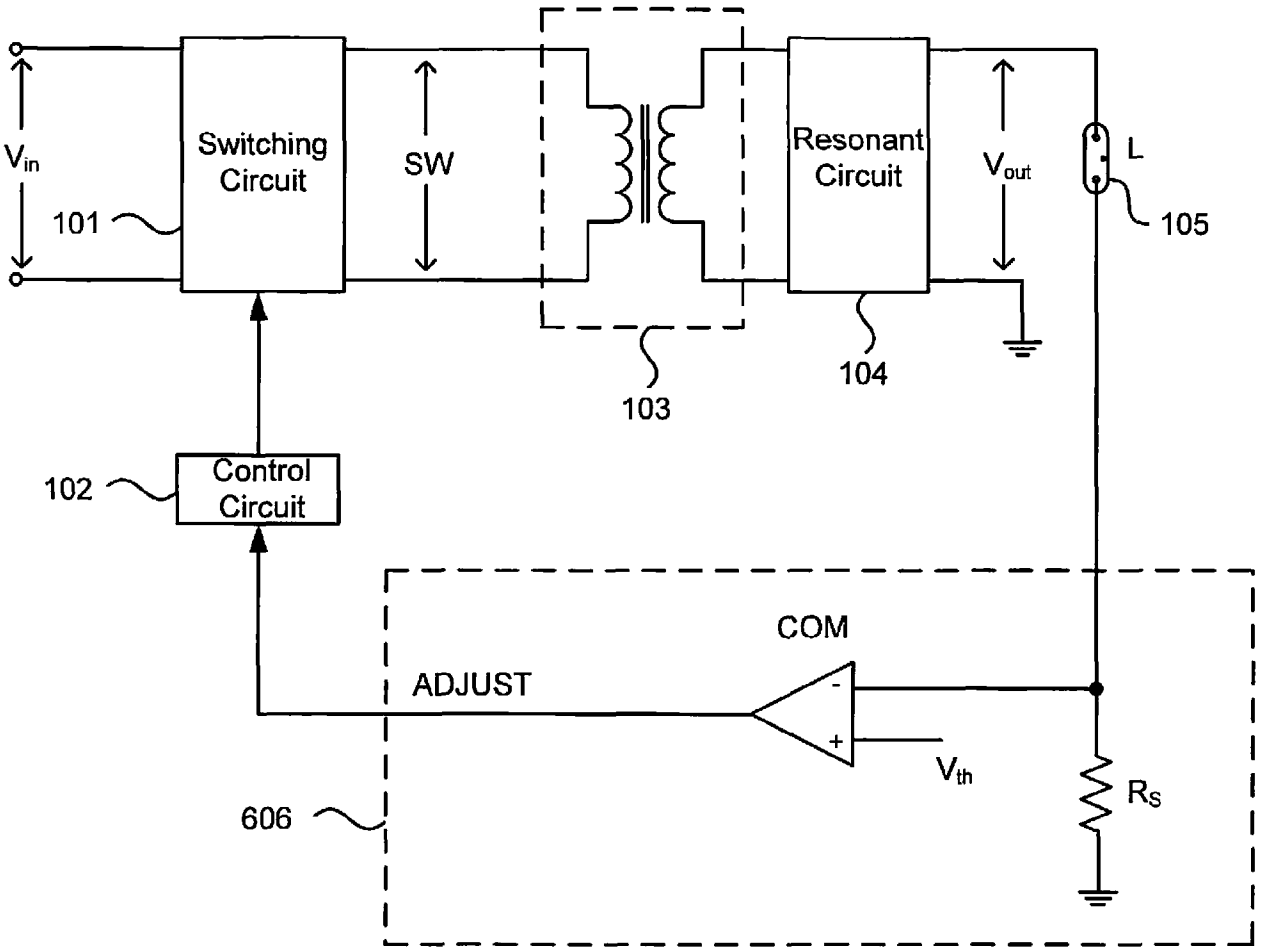
FIG. 7 is a block diagram of a driving circuit for driving a single discharge lamp in accordance with embodiments of the disclosure.

FIG. 7 is a block diagram of a driving circuit for driving a single discharge lamp in accordance with embodiments of the disclosure. A frequency hopping method is used in the following description though other suitable methods may also be used. The load 105 comprises a discharge lamp L. The status monitoring circuit 606 comprises a current sensing circuit and a current comparison circuit. The current sensing circuit is electrically coupled to the lamp L to sense the current flowing through the lamp L, and to generate a current sensing signal. The current comparison circuit is electrically coupled to the current sensing circuit and the control circuit 102. The current comparison circuit compares the current sensing signal with a threshold signal $V_{th}$ to detect whether an open circuit condition exists. When an open circuit condition is detected, the current comparison circuit validates the adjustment signal ADJUST to let the control circuit 102 reduce the duty cycle of the switching signal SW, so as to at least reduce the overshoot caused by frequency hopping.

In one embodiment, the current sensing circuit comprises a resistor $R_s$, and the current comparison circuit comprises a comparator COM. The resistor $R_s$ is electrically connected between the lamp L and the ground. The inverting input terminal of the comparator COM is electrically connected to the resistor $R_s$ and the lamp L, while the non-inverting input terminal receives the threshold $V_{th}$. The output signal of the comparator COM is the adjustment signal ADJUST. When the voltage across the resistor $R_s$ becomes smaller than the threshold $V_{th}$, indicating that an open circuit condition is detected, the adjustment signal ADJUST is valid (e.g., the rising edge), and the control circuit 102 adjusts the control signal to reduce the duty cycle of the switching signal SW, so as to at least reduce or eliminate the overshoot caused by frequency hopping.

Figure 8:
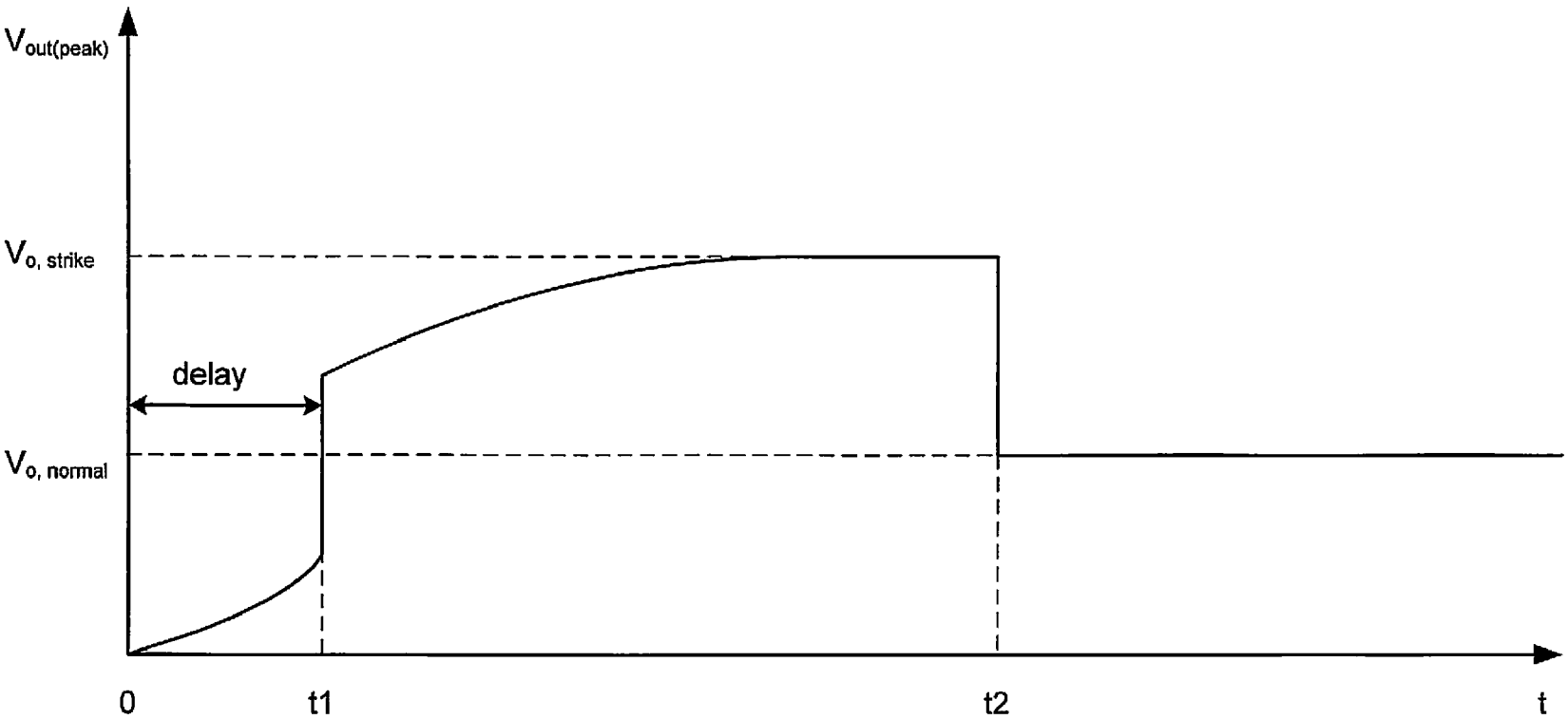
FIG. 8 is a diagram illustrating a waveform of the peak output voltage with respect to time during ignition in the driving circuit in FIG. 7 in accordance with embodiments of the disclosure.

FIG. 8 is a diagram illustrating a waveform of the peak output voltage with respect to time during ignition in the driving circuit in FIG. 7 in accordance with embodiments of the disclosure. At t=0, the driving circuit is powered on, the lamp L is not ignited, the open circuit condition is not detected, and the adjustment signal ADJUST is invalid. The switching frequency is the operation frequency $f_s$ and the voltage gain is G2.

During 0<t<t1, the duty cycle of the switching signal SW is increased by the control circuit 102, and the output voltage $V_{out}$ is increased accordingly. At t=t1, the open circuit condition is detected, the adjustment signal ADJUST is valid, the frequency is set to the frequency $f_{s,open}$, and the voltage gain is G3. The control circuit 102 adjusts the control signal to reduce the duty cycle of the switching signal SW. As a result, the overshoot can be at least reduced or even eliminated. Then, the duty cycle of the switching signal SW is increased by the control circuit 102 until the output voltage $V_{out}$ is regulated to the striking voltage $V_{o,strike}$. At t=t2, the lamp L is ignited, the switching frequency is set to be the operation frequency $f_s$ again, the voltage gain is G1, and the output voltage $V_{out}$ is the operation voltage $V_{o,normal}$.

Figure 9:
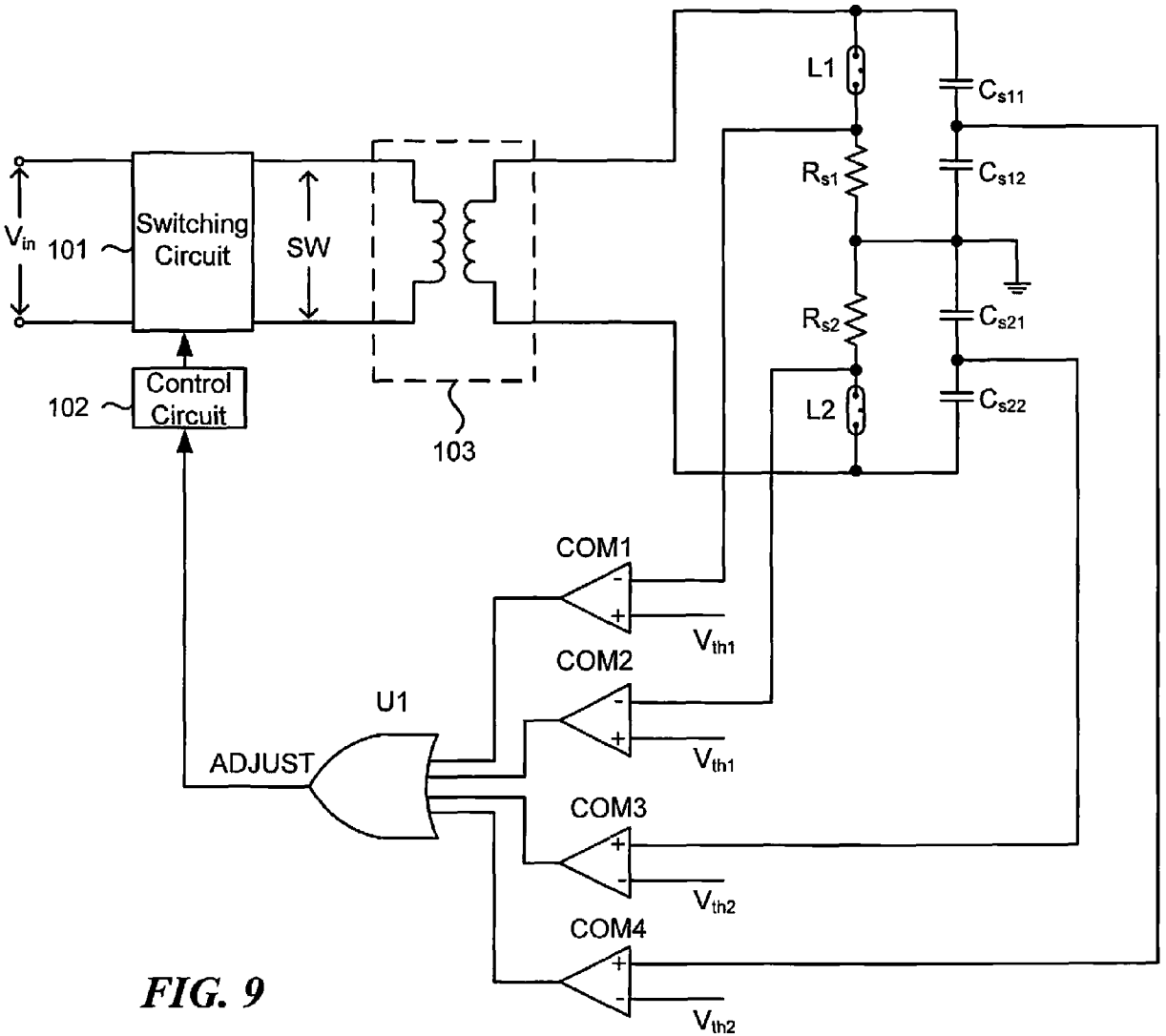
FIG. 9 is a block diagram of a driving circuit for driving two serially connected discharge lamps in accordance with embodiments of the disclosure.

FIG. 9 is a block diagram of a driving circuit for driving two serially connected discharge lamps in accordance with embodiments of the disclosure. Even though a frequency hopping method is used in the following description, in certain embodiments, other suitable methods may also be used.

The load 105 comprises two serially connected discharge lamps L1 and L2. The status monitoring circuit 606 comprises a current sensing circuit, a current comparison circuit, a voltage sensing circuit, a voltage comparison circuit and a signal processing circuit. The current sensing circuit is electrically coupled to the lamps L1 and L2. The current sensing circuit senses the current flowing through the lamps and generates current sensing signals representative of them. The current comparison circuit is electrically coupled to the current sensing circuit and the signal processing circuit. The current comparison circuit compares the current sensing signals with a threshold voltage $V_{th1}$ to determine whether an open circuit condition exists.

The voltage sensing circuit is electrically coupled to the lamps L1 and L2. The voltage sensing circuit senses the voltage across the lamps and generates voltage sensing signals representative of them. The voltage comparison circuit is electrically coupled to the voltage sensing circuit and the signal processing circuit. The voltage comparison circuit compares the voltage sensing signals with a threshold voltage $V_{th2}$ to determine whether an over-voltage condition exists. The signal processing circuit is electrically coupled to the current comparison circuit and the voltage comparison circuit. The signal processing circuit receives their comparison results and validates the adjustment signal ADJUST when the open circuit or over-voltage condition is detected, and thereby allowing the control circuit 102 to reduce the duty cycle of the switching signal SW, so as to at least reduce or even eliminate any overshoot.

In one embodiment, the current sensing circuit comprises resistors $R_{s1}$ and $R_{s2}$. The current comparison circuit comprises comparators COM1 and COM2. The voltage sensing circuit comprises capacitors $C_{s11}$, $C_{s12}$, $C_{s21}$ and $C_{s22}$. The voltage sensing circuit comprises comparators COM3 and COM4, and the signal processing circuit comprises an OR gate U1, electrically connected as shown in FIG. 9. When the voltage across the resistor $R_{s1}$ or $R_{s2}$ becomes smaller than the threshold $V_{th1}$, which indicates the open circuit condition exits, or the voltage generated by the voltage divider comprising $C_{s11}$, and $C_{s12}$, or $C_{s21}$ and $C_{s22}$ becomes larger than the threshold $V_{th2}$, which indicates an over-voltage condition exists, the adjustment signal ADJUST is set to be valid (such as rising edge). The control circuit 102 accordingly adjusts the control signal to reduce the duty cycle of the switching signal SW.

Figure 10:
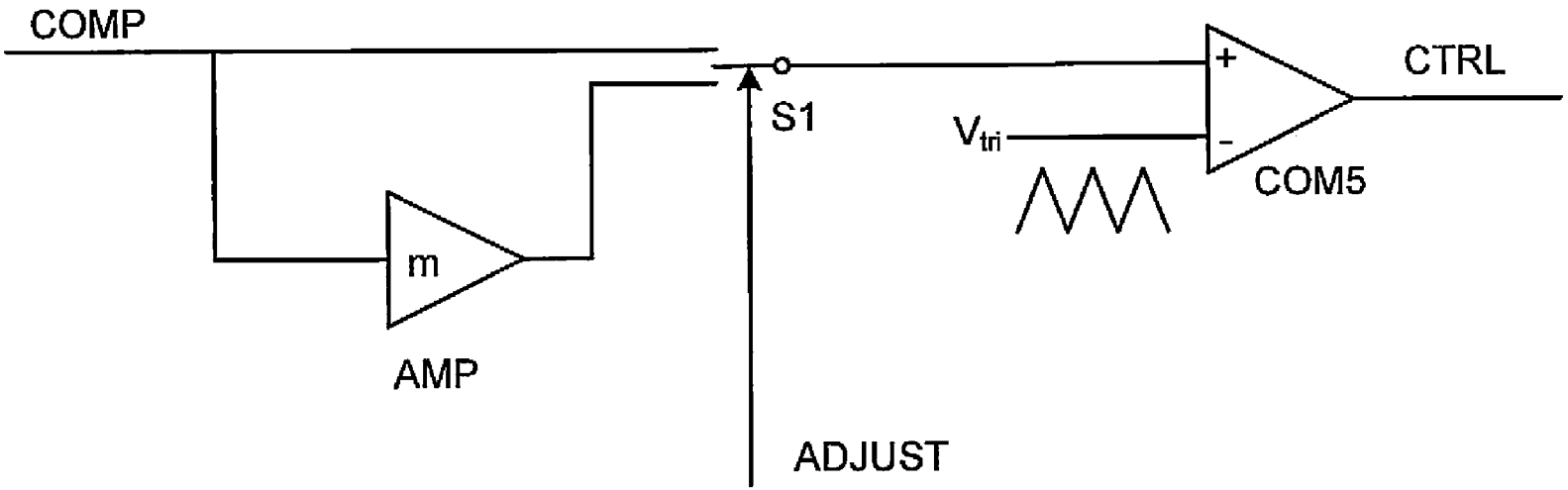
FIG. 10 illustrates a portion of the control circuit in FIG. 6 in accordance with embodiments of the disclosure.

FIG. 10 illustrates a portion of the control circuit 102 in FIG. 6 in accordance with embodiments of the disclosure. The control circuit 102 comprises an amplifier circuit AMP, a selective switch S1, and a comparator COM5. The amplifier circuit AMP may be any circuit that can realize the signal amplification. The gain of the amplifier circuit AMP is m, wherein m is a positive constant which is smaller than one. In one embodiment, m is 0.5. In other embodiments, m can be 0.75, 0.8, 0.85, or other suitable values.

In operation, the amplifier circuit AMP receives a CMP signal and generates an amplified CMP signal to one input terminal of the selective switch S1. The other input terminal of the selective switch S1 receives the CMP signal, the output terminal of the selective switch S1 is electrically connected to the non-inverting input terminal of the comparator COM5, the control terminal of the selective switch S1 is electrically coupled to the status monitoring circuit 606 to receive the adjustment signal ADJUST.

The inverting input terminal of the comparator COM5 receives a triangular signal $V_{tri}$, and the output terminal of the comparator COM5 outputs a control signal CTRL to control the on and off of the at least one switch in the switching circuit 101. The amplified CMP signal is transmitted to the non-inverting input terminal of the comparator COM5 by the selective switch S1 if the abnormal working status of the discharge lamps is detected (such as the high level period of the adjustment signal ADJUST). The CMP signal is transmitted to the non-inverting input terminal of the comparator COM5 by the selective switch S1 if no abnormal working status of the discharge lamps is detected (such as the low level period of the adjustment signal ADJUST).

The CMP signal may be a predetermined voltage signal, or a signal generated by the control circuit 102 through sensing, comparing, and/or compensating of the electrical parameters of the lamp. In one embodiment, if the open circuit condition is detected, the control circuit 102 senses the voltage across the lamp, compares the voltage sensing signal with a threshold representative of the striking voltage, compensates the comparison signal and uses the compensated signal as the CMP signal. If no open circuit condition is detected, the control circuit 102 senses the current flowing through the lamp, compares the current sensing signal with a threshold representative of the expected lamp current, compensates the comparison signal and uses the compensated signal as the CMP signal.

Figure 11:
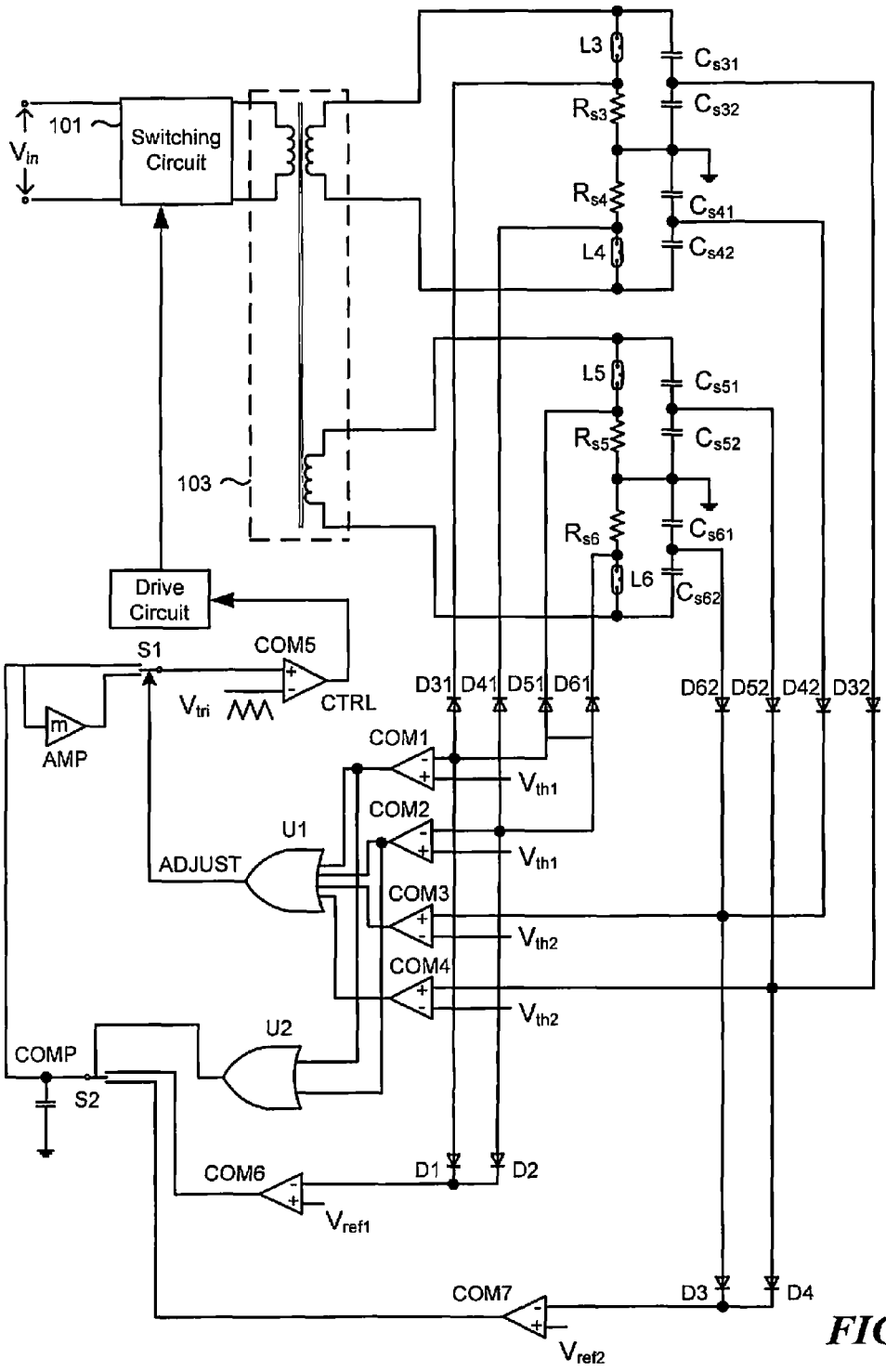
FIG. 11 is a block diagram of a driving circuit for driving four discharge lamps in accordance with embodiments of the disclosure.

FIG. 11 is a block diagram of a driving circuit for driving four discharge lamps in accordance with embodiments of the disclosure. The load 105 comprises four discharge lamps L3-L6. The transformer 103 comprises two secondary windings, each of which is electrically connected to two serially connected discharge lamps. The status monitoring circuit 606 comprises a current sensing circuit, a current comparison circuit, a voltage sensing circuit, a voltage comparison circuit and a signal processing circuit.

The current sensing circuit comprises resistors $R_{s3}$, $R_{s4}$, $R_{s5}$ and $R_{s6}$. The current sensing circuit senses the current flowing through the discharge lamps L3-L6. The voltage sensing circuit comprises capacitors $C_{s31}$, $C_{s32}$, $C_{s41}$, $C_{s42}$, $C_{s51}$, $C_{s52}$, $C_{s61}$, $C_{s62}$, every two of which may form a voltage divider to sense the voltage across a discharge lamp. The current comparison circuit comprises diodes $D_{31}$, $D_{41}$, $D_{51}$, $D_{61}$, and comparators COM1, COM2. The current comparison circuit detects whether the open circuit condition exists. The voltage comparison circuit comprises diodes $D_{32}$, $D_{42}$, $D_{52}$, $D_{62}$, and comparators COM3, COM4. The voltage comparison circuit detects whether the over-voltage condition exists. The signal processing circuit comprises an OR gate U1. The signal processing circuit validates the adjustment signal ADJUST when the open circuit or over-voltage condition is detected.

The control circuit 102 comprises an amplifier circuit AMP, selective switches S1 and S2, a comparator COM5, a voltage loop, a current loop and an open circuit monitoring circuit. The open circuit monitoring circuit is electrically coupled to the current comparison circuit to detect whether the open circuit condition exists. In one embodiment, it comprises an OR gate U2. The selective switch S2 is switched to the voltage loop if the open circuit condition is detected, and switched to the current loop if no open circuit condition is detected. If the working status of the discharge lamps L3-L6 is normal, the CMP signal is transmitted by the selective switch S1, else, the amplified CMP signal is transmitted by the selective switch S1.

Figure 12:
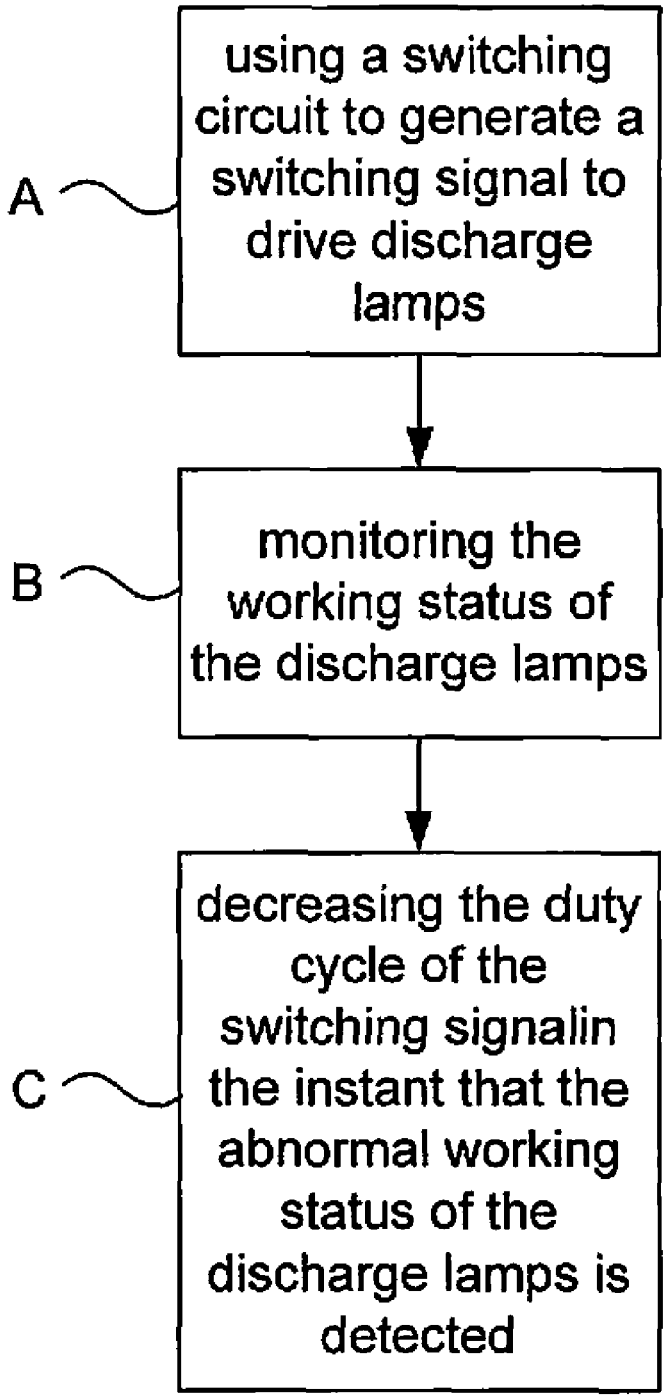
FIG. 12 is a flowchart showing a method for driving discharge lamps in accordance with embodiments of the disclosure.

FIG. 12 is a flowchart showing a method for driving discharge lamps in accordance with embodiments of the disclosure. As shown in FIG. 12, the method includes using a switching circuit to generate a switching signal to drive discharge lamps. The method also includes monitoring the working status of the discharge lamps. The method further includes decreasing a duty cycle of the switching signal when the abnormal working status of the discharge lamps is detected. In one embodiment, the abnormal working status of the discharge lamps comprises an open circuit condition. In another embodiment, the abnormal working status of the discharge lamps comprises an over-voltage condition. In still another embodiment, the abnormal working status of the discharge lamps comprises an open circuit or over-voltage condition. In certain embodiments, the duty cycle of the switching signal is decreased to one half of its original value when the abnormal working status of the discharge lamps is detected. In other embodiments, the duty cycle of the switching signal can be decreased to ⅓, ¼, ¾ of its original value or other suitable values when the abnormal working status of the discharge lamps is detected From the foregoing, it will be appreciated that specific embodiments of the invention have been described herein for purposes of illustration, but that various modifications may be made without deviating from the invention. For example, many of the elements of one embodiment may be combined with other embodiments in addition to or in lieu of the elements of the other embodiments. Accordingly, the invention is not limited except as by the appended claims.

We claim:

1. An apparatus for a driving discharge lamp, comprising:

a switching circuit electrically coupled to a discharge lamp, the switching circuit comprising a switch configured to generate a switching signal to drive the discharge lamp;

a status monitoring circuit operatively coupled to the discharge lamp, the status monitoring circuit configured to monitor a working status of the discharge lamp; and a control circuit configured to control the switching signal produced by the switch based at least in part on the working status monitored by the status monitoring circuit, wherein the control circuit is configured to decrease a duty cycle of the switching signal when the working status of the discharge lamp indicates abnormality and wherein the control circuit comprises:

an amplifier circuit configured to receive a compensation signal and generate a compensation signal;

a selective switch having a first input terminal configured to receive the compensation signal, a second input terminal electrically connected to the amplifier circuit and configured to receive the amplified compensation signal, and a control terminal electrically coupled to the status monitoring circuit; and a comparator having an inverting input terminal configured to receive a triangular signal, a non-inverting input terminal electrically connected to an output terminal of the selective switch, and an output terminal electrically coupled to the switching circuit and configured to control an on/off state of the switch;

wherein if abnormality is indicated, the selective switch is configured to transmit the amplified compensation signal to the non-inverting input terminal of the comparator; otherwise, the selective switch is configured to transmit the compensation signal to the non-inverting input terminal of the comparator.

2. The apparatus of claim 1, wherein a gain of the amplifier circuit is a positive constant less than one.

3. The apparatus of claim 1, wherein the amplifier circuit is configured to generate the compensation signal by sensing, comparing, and compensating of electrical parameters of the discharge lamp.

4. The apparatus of claim 3, wherein the electrical parameters of the discharge lamp comprises voltage, current, and/or power.

5. The apparatus of claim 3, wherein if an open circuit condition is indicated, the amplifier circuit is configured to generate the compensation signal by sensing, comparing, and compensating the voltage across the discharge lamp; otherwise, the amplifier circuit is configured to generate the compensation signal by sensing, comparing, and compensating of the current flowing through the discharge lamp.

* * * * *